United States Patent [19]

Iijima et al.

[11] 4,445,417

[45] May 1, 1984

[54] METHOD AND MACHINE FOR MAKING SQUARE-MESHED NET

[75] Inventors: Toshikazu Iijima, 20, Shimogou, Isshiki-cho, Gamagouri-Shi, Aichi-ken, Japan; Shuichi Ito, Yotsukaichi, Japan

[73] Assignee: Toshikazu Iijima, Aichi, Japan

[21] Appl. No.: 223,784

[22] Filed: Jan. 9, 1981

[30] Foreign Application Priority Data

Apr. 23, 1980 [JP] Japan ..... 55-52987

[51] Int. Cl.[3] ..... D04G 1/08

[52] U.S. Cl. ..... 87/12; 87/53; 289/1.5; 289/2; 289/18.1

[58] Field of Search ..... 87/12, 53; 289/1.5, 289/2, 5–9, 18.1

[56] References Cited

U.S. PATENT DOCUMENTS 2,219,015 10/1940 Nishiguchi ..... 87/53

3,995,898 12/1976 Momoi ..... 289/1.5

4,139,225 2/1979 Maruyama et al. ..... 289/1.5

*Primary Examiner*—John Petrakes

*Attorney, Agent, or Firm*—Armstrong, Nikaido, Marmelstein & Kubovcik

[57] ABSTRACT

The invention relates to square-meshed net, and method and machine for knotting the same. In knotting a net using upper hooks arranged in a line, warp is arranged in opposition to the upper hooks and knotted to weft by the same upper hook as that in opposition to warp, and weft is transferred in one cycle of the knotting to next upper hook in a prescribed direction and knotted to warp by the next upper hook. In knotting a net using upper hooks arranged in circular form, warp (or weft) is knotted to weft (or warp) by the same upper hook as that in opposition to warp (or weft), and weft (or warp) is transferred in one cycle of the knotting to next upper hook in a prescribed direction and knotted to warp (or weft) by the next upper hook. Warp and weft are perpendicular to each other at the unfolded state and rectangular meshes are constituted. In some case, weft is turned twice and constitutes S-shaped loop.

8 Claims, 26 Drawing Figures

I

FIG.8
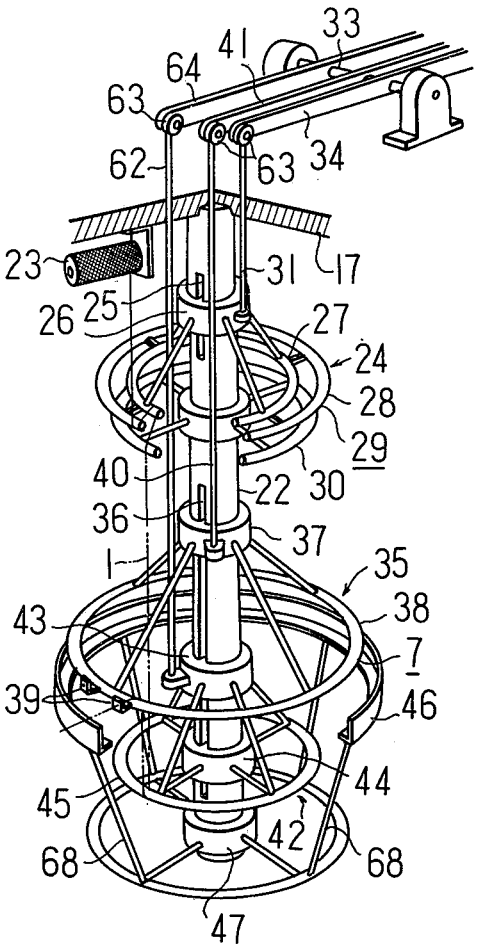
FIG.9
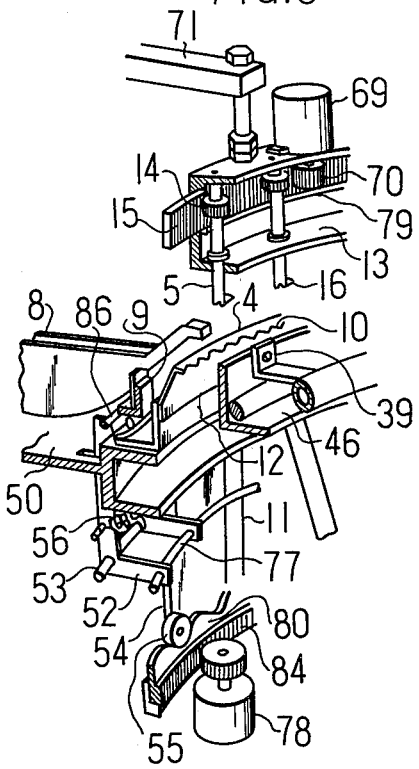
FIG.11
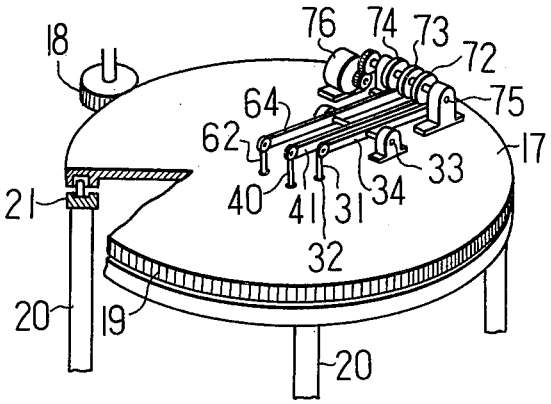
FIG.12B
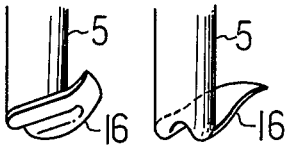
FIG.12A

METHOD AND MACHINE FOR MAKING SQUARE-MESHED NET

BACKGROUND OF THE INVENTION (1) Field of the Invention

The present invention relates to a square-meshed net used for fishing, agriculture, sports, and the like and a method and machine for knotting the same.

(2) Description of the Prior Art

In what is called an English knotted net, the warp and weft run in zigzag fashion when the net is in an unfolded condition. The warp and weft in their connection at the knot are adapted to turn. The mesh so knotted is formed in a rhombic shape. However, for fishing, agriculture, and sports, the direction of the warp and weft forming the rectangular net is often required to be parallel to each side of the rectangle. In other words, the form of the mesh should be square with the overall shape of the net.

For this purpose, the English knotted net has been used so far only by being cut diagonally to prepare a square-meshed net. However, this requires a great deal of labor and material. Moreover, even with a thus manufactured square-meshed net, warp and weft run in zigzag, so that if the net is unfolded and loaded with increasing tension to warp and weft, knots connected to warp and weft are liable to lose balance and to be lacking in strength as a net. Such a net would have little or no utility.

SUMMARY OF THE INVENTION

An object of the present invention is to provide a square-meshed net, in which the group of warp runs straight on and the group of weft runs slantingly to cross each other, and the weft knotted with the wrap travels in a certain horizontal direction to be knotted with next warp at every knotting and knotted to flat board which warp and weft cross each other at a right angle when the net is unfolded.

Another object of the present invention is to provide a square-meshed net, in which at a knotting stage, the group of weft (the group of warp) is arranged along the generating line of a cylinder and the group of warp (the group of weft) is arranged spirally along the cylinder, and warp and weft cross each other and warp (weft) crossed with weft (warp) is cylindrically knotted at every knotting so as to be knotted with next weft (warp), thus providing a square-meshed net which warp and weft meet at a right angle with the net unfolded in flat, by either cutting the group of weft along a line of warp or cutting the group of warp along a line of weft.

Further object of the present invention is to provide a square-meshed net, in which weft is turned twice and formed to be S-shaped loop and knotted with warp.

Still further object of the present invention is to provide method and a machine knotting a square-meshed net which warp and weft meet at a right angle under the unfolded condition.

These and further objects and advantages of the present invention will become more apparent upon reference to the following specification and drawings. It should be understood that these drawings are solely descriptive and not limiting the scope of the present invention.

BRIEF DESCRIPTION OF THE DRAWINGS

FIGS. 1 to 7 relate to the first embodiment of a flat type net knotting machine:

FIG. 1 is a partial section of an elevational view; FIG. 2 is a partial section of a side view; FIGS. 3A to 3I are schematic illustrations showing the sequential steps of net knotting process; FIG. 4 is a frontview showing knots before fastening; FIG. 6 is a front view showing the net knotted as it is; FIG. 7 is a front view showing the net which is unfolded to be a square-meshed condition.

FIGS. 8 to 17 relate to the second embodiment of a circular type net knotting machine:

FIG. 8 is a perspective view showing the framework of the net knotting machine; FIGS. 9 to 11 are perspective views showing the details of respective parts; FIGS. 12A and B are perspective views showing the main portions of the upper hook; FIG. 13 is a partial section of a front view showing the vicinity of the upper portion of the net knotting machine, FIG. 14 is a brief partial section of a front view showing the vicinity of the lower portion of the machine; FIG. 15 is a partial section of a front view showing the outer circumference of the lower portion of the machine; FIGS. 16 and 17 are perspective views showing the net as it is knotted to cylindrical condition.

DESCRIPTION OF THE PREFERRED EMBODIMENT

First Embodiment (Refer to FIGS. 1 to 7)

Figure 1:
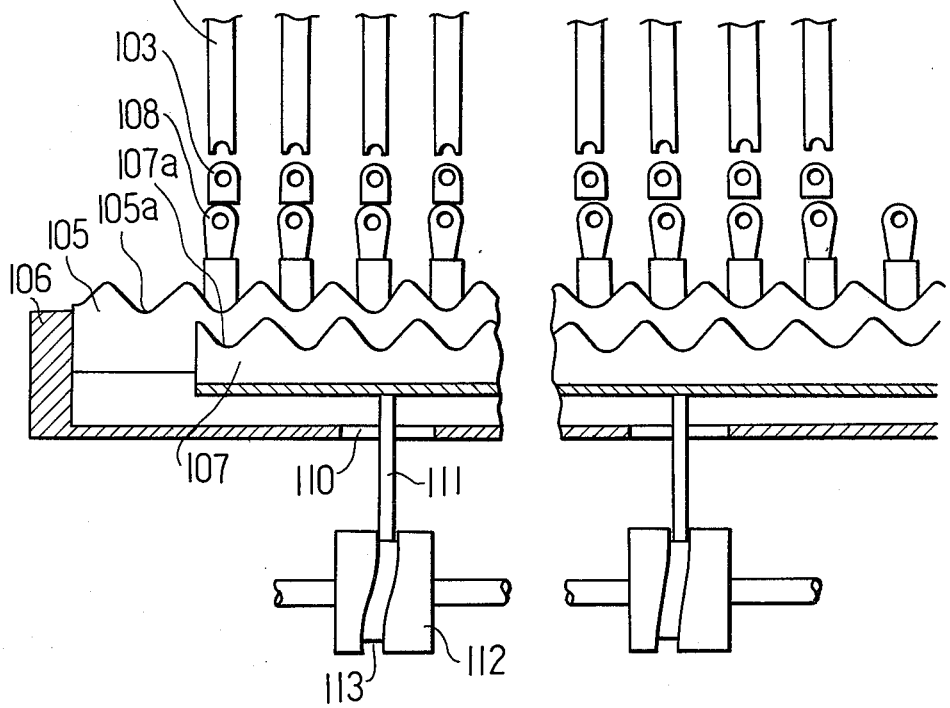
Figure 2:
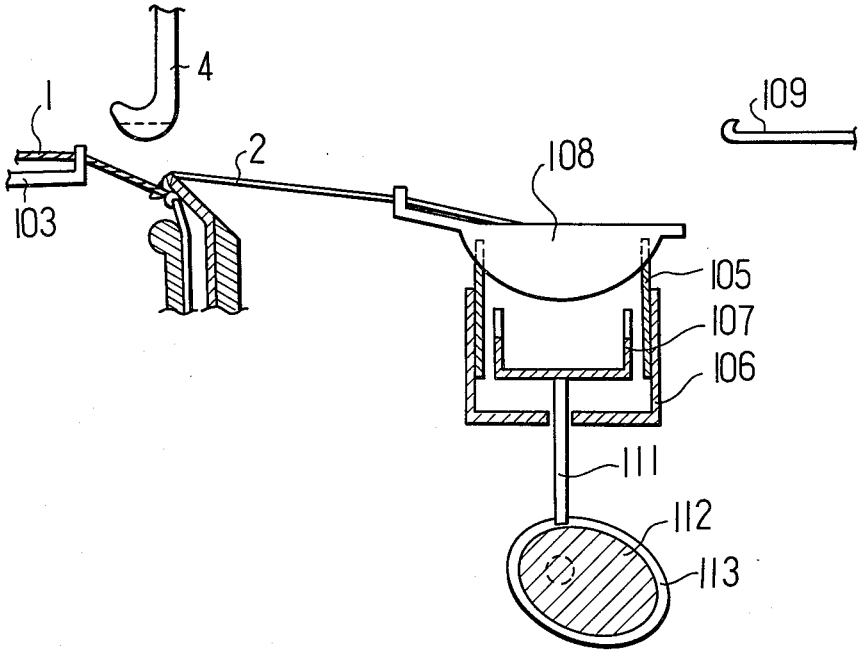
Figure 3:
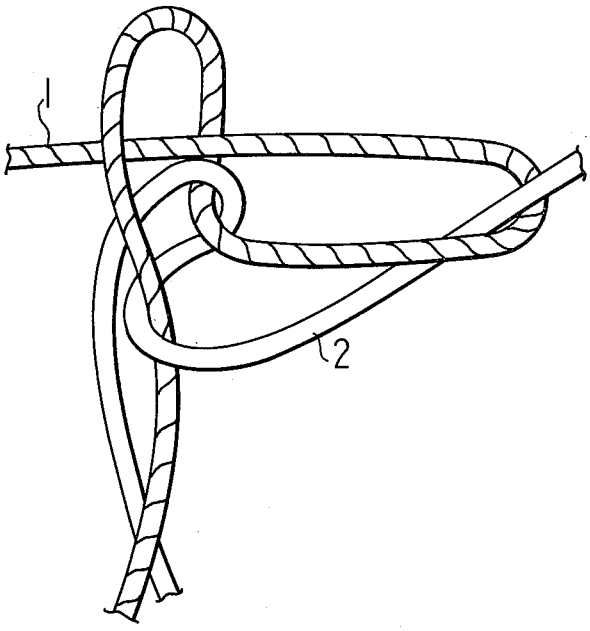

In FIG. 1, warp 1 is pulled out from a warp package (not shown) and led forward to a warp guide member 103 and weft 2 is wound around a bobbin housed in a bobbin case 108 and led backward to a guide hole of the bobbin case. Numeral 104 is an upper hook and numeral 109 is a lower hook. Each of the above-mentioned members is constituted as similar to the conventional english knotted net manufacturing machine. These members are arranged in a right angle direction (right and left direction) to the surface of paper in plural sets. Each bobbin case 108 is loaded on a concave stopper 105*a* of a pair of a case receiver 105 in front and rear fixed in a case 106 similarly to the conventional net knotting machine and arranged in the middle of a pair of the case receiver 105 in front and rear and corresponds to a concave stopper 107*a* arranged in front and rear lines of a travelling case receiver 107. And, a logarithum of the concave stopper 107*a* is equal to the number of the bobbin case 108 and a logarithum of the concave stopper 105*a* is formed to be superior by one pair to the number of bobbin case 108.

At the middle lower part of the travelling case receiver 107, a couple of a supporting legs 111 are hanged on right and left downwards and are engaged with a long guide hole which passed through right and left directions in the case 106. The lower end of the leg is engaged with a cam slot 113 cut in on an eccentric cam 112 which is adapted to make one turning during one cycle of net knotting movement. And, the travelling case 107 makes reciprocating movement in the right and left directions by one pitch of the concave stopper 107*a* while the case makes up and down movement. Thus, a flat type net knotting machine provided with those above mentioned member is formed.

Then, the net knotting steps by means of this net knotting machine will be described, referring to FIGS.

3A to 3I. In these drawings, a circle or circular arc illustrated on the upper part of the drawings shows the overhead view of the direction of the upper hook 104 and the turning direction, where the warp 1, weft 2, warp guide member 103, upper hook 104 and lower hook 109 are viewed from the left side, while the case receiver 105, case 106, travelling case receiver 107 and bobbin case 108 are viewed from the front.

Figure 3A:
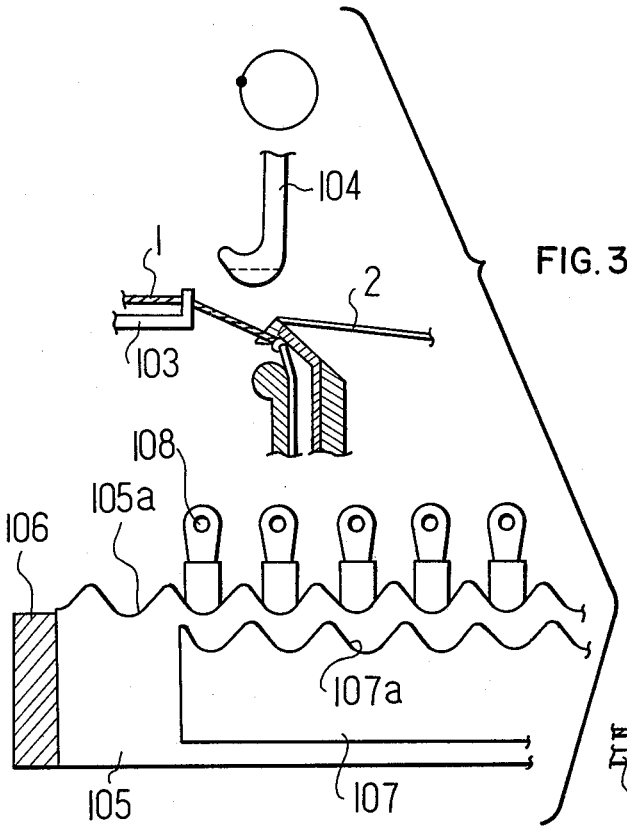

A Starting Position (FIG. 3A)

The upper hook 104 looks toward the warp guide member 103; the bobbin case 108 is loaded on the concave stopper 105*a* of the case receiver 105, and the concave stopper 107*a* of the travelling case receiver is located on a level lower than the bobbin case 108 and a little to the right of the bobbin case 108.

Figure 3B:
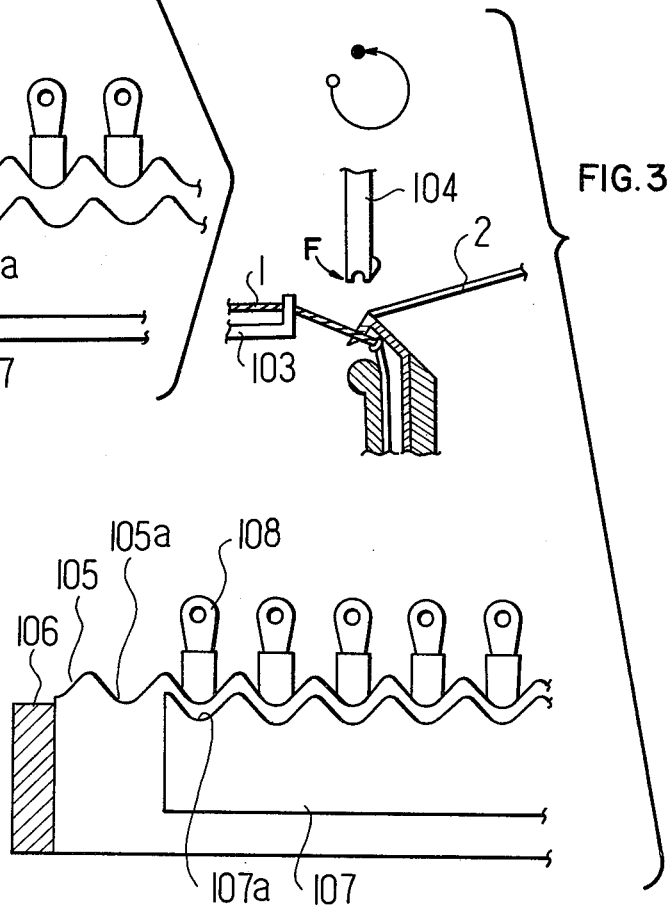

Step B (FIG. 3B)

The upper hook 104 turns three quarter to the counterclockwise direction and waits for a rise of the bobbin case 108. The travelling case receiver 107 begins travelling leftward during a rise movement.

Figure 3C:
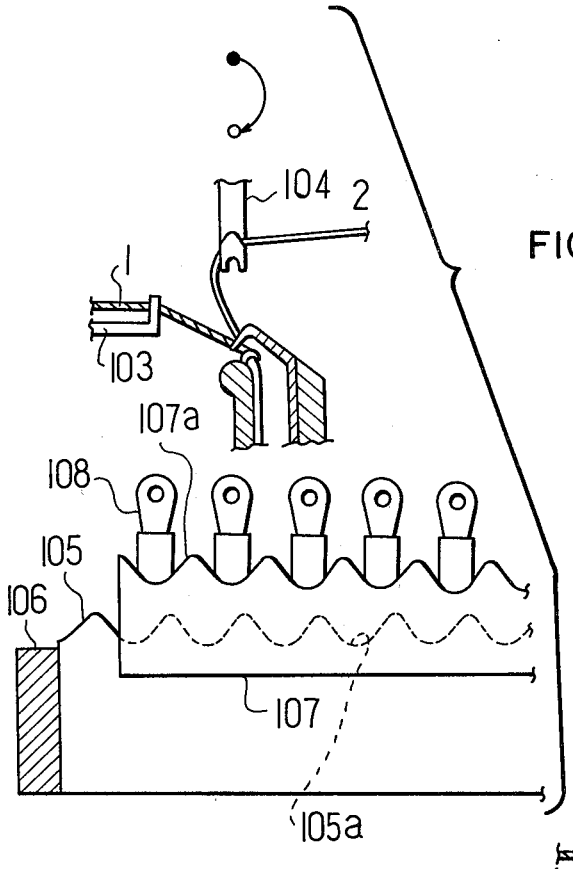

Step C (FIG. 3C)

The travelling case receiver 107 rises, onto which the bobbin case 108 loaded on the case receiver 105 is transferred, and travels leftward continuously. The upper hook 104 makes a half turn to the clockwise direction and hooks the weft 2 which is risen by the rise of the bobbin case 108.

Figure 3D:
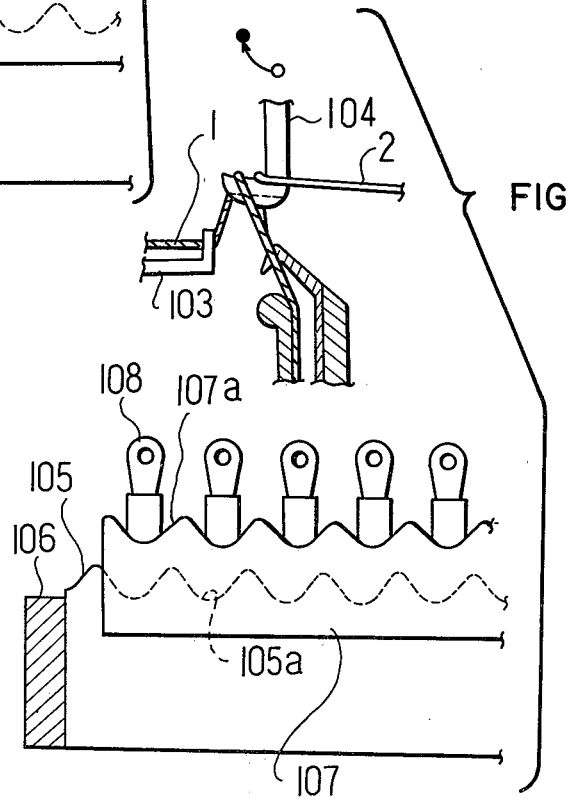

Step D (FIG. 3D)

The upper hook makes more a quarter turn to the clockwise direction, looks toward the warp guide member 103 and hooks down the warp 1 in the reverse direction of the weft 2, interlocking with the well-known movement of the warp guide member 103.

Figure 3E:
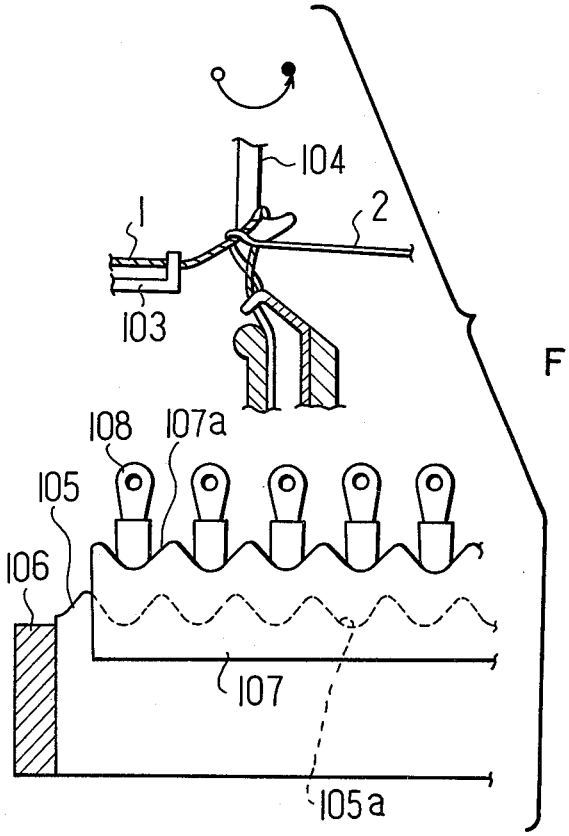

Step E (FIG. 3E)

The upper hook 104 makes a half turn to the counterclockwise direction and the weft 2 slides off of the upper hook 104 and slips down and around the outside of the loop of the warp 1 hanging down from the upper hook 104, encircling the outside of the loop. The travelling case receiver 107 begins falling, moving the bobbin case to the left.

Figure 3F:
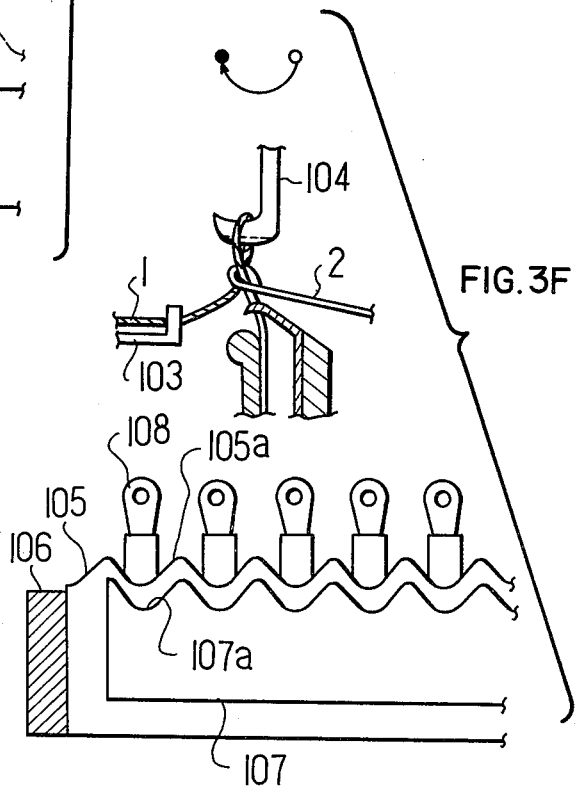

Step F (FIG. 3F)

The upper hook 104 makes a half turn to the clockwise direction, looks towards the warp guide member 103 and waits for admission of the lower hook 109. The travelling case receiver 107 falls and transfers the bobbin case 108 to the left-sided stopper 105*a* of the concave stopper 105*a* of the case receiver 105 on which the bobbin case 108 was loaded before, and falls further.

Figure 3G:
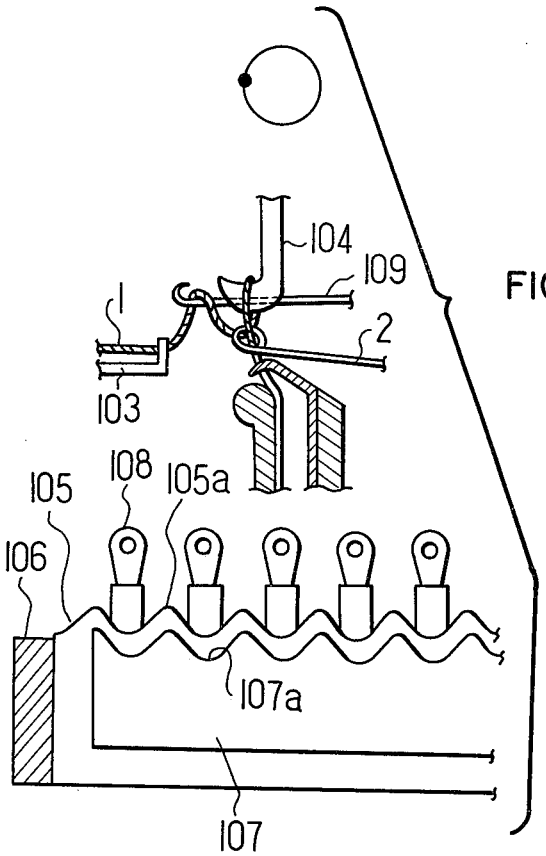

Step G (FIG. 3G)

The lower hook 109 advances along the groove arranged on the surface F of the upper hook 104 and hooks the warp 1 from the left side to the right side of the lower hook 109 by means of the well-known movement of the warp guide member 103. The travelling case receiver 107 falls to the position little lower than the bobbin case 108 and then begins travelling to the right.

Figure 3H:
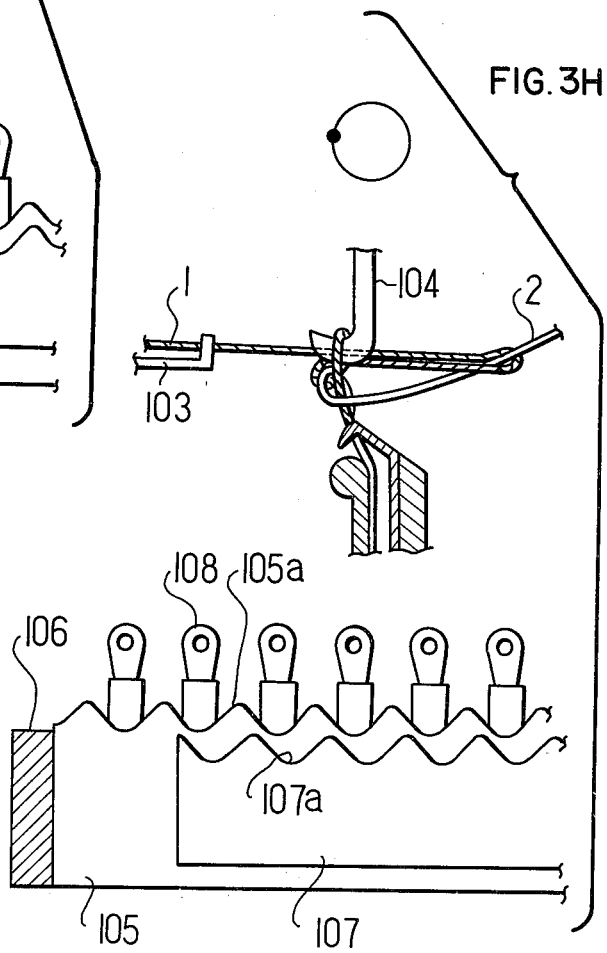

Step H (FIG. 3H)

The lower hook 109 pulls the loop of the warp 1 out to this side. When the loop of the warp 1 strides across bobbin case 108 finishing travelling to the left, the loop of the warp 1 trips the lower hook 109. The travelling case receiver 107 travels to the right and returns to the starting position. The relation between the warp 1 and the weft 2 at this time is shown in FIG. 3I.

Step I

Figure 5A:
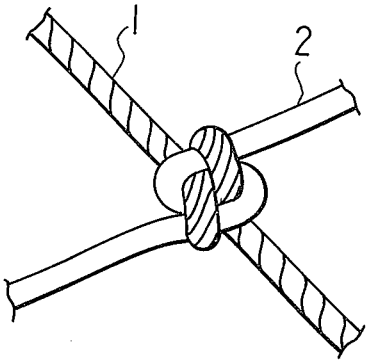
FIG. 5A is a front view showing knots after fastening.
Figure 5B:
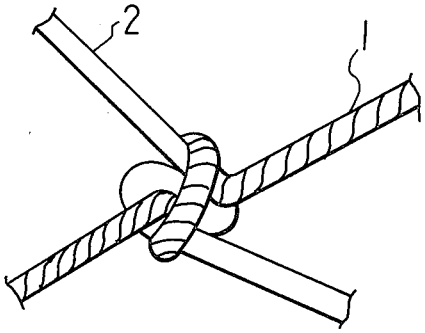
FIG. 5B is a back view of the former.
Figure 4:
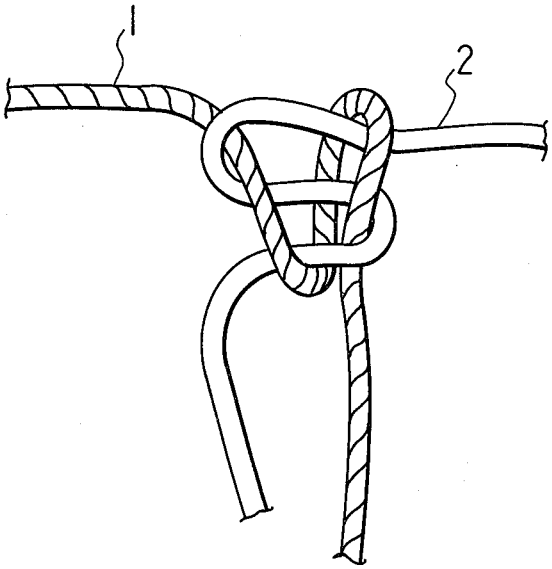

The warp 1 is pulled backward by means of the fall movement of the well-known falling shaft (not shown), the loop of the warp 1 formed by the lower hook 109 is retracted and the loop of the weft 2 is formed. The upper hook 104 is slanted and the loop of the warp 1 is pulled out of the upper hook 104, and the balanced knot construction is formed as shown in FIG. 4, in which N-shaped loops of the warp 1 and S-shaped loops of the weft 2 twine together. Meshes are fastened by increasing tension, and knots become tight as shown in FIGS. 5A and 5B and the warp 1 and the weft 2 cross each other at a right angle through knots.

Step J

The net is rolled by the well-known net roller (not shown) as long as the length between knots. And the weft 2 linking to the knot at the extreme left is cut from the knot at the prescribed position, the bobbin case 108 linked to this weft 2 is removed from the case receiver 105 and the other bobbin case 108 is loaded afresh on the concave stopper 105*a* at the right end of new case receiver 105. The tip of the weft 2 of this bobbin case 108 is fixed at the prescribed position until the knot forming step in next net knotting cycle is finished.

Figure 6:
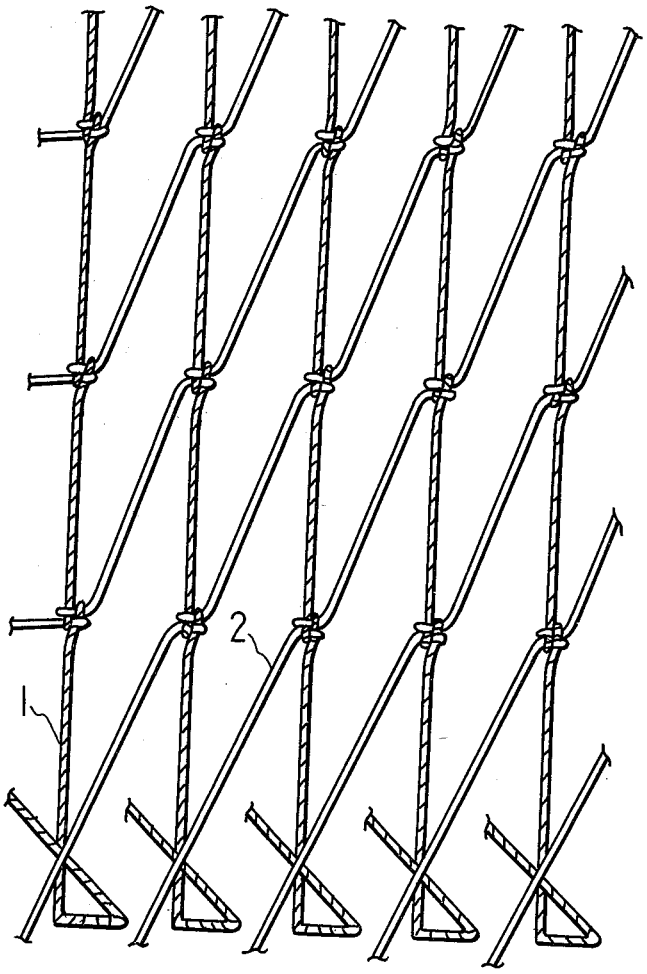
Figure 7:
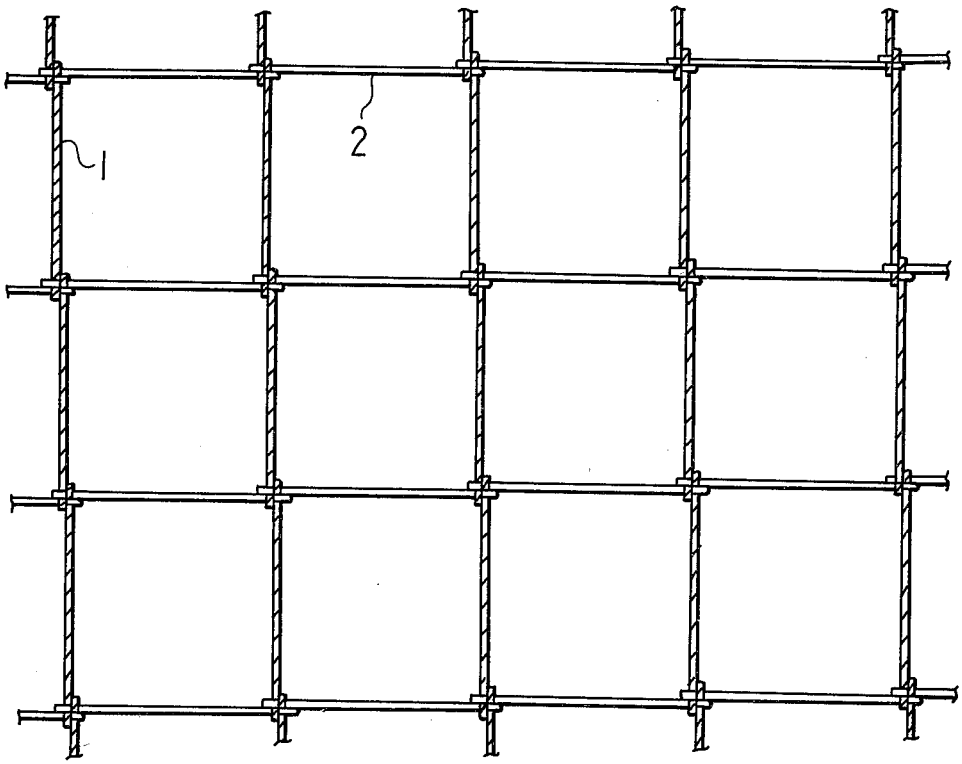
Figure 10:
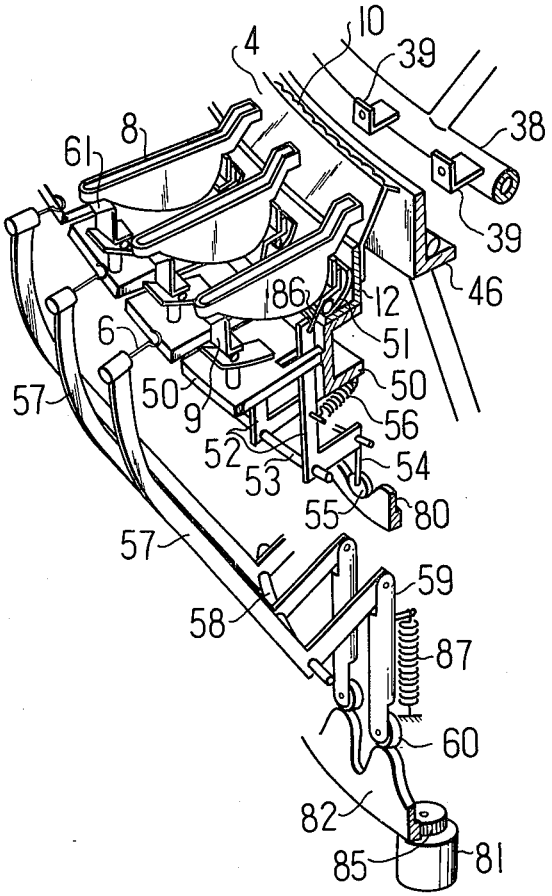
Figure 13:
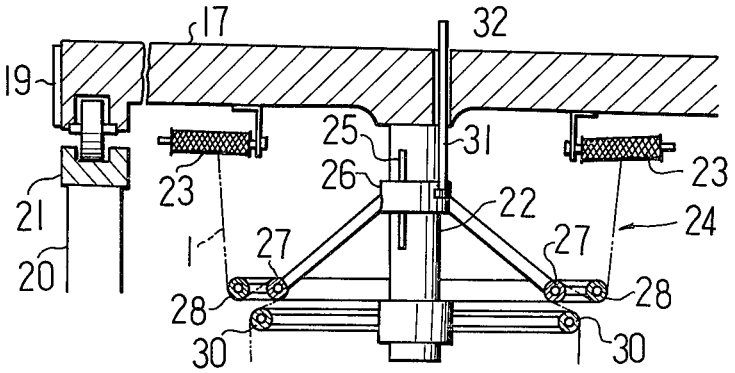
Figure 14:
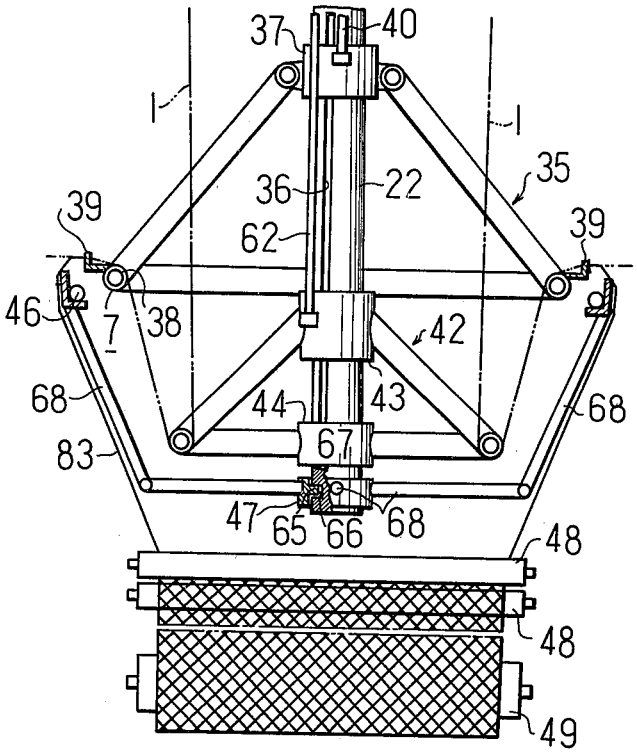

As the above mentioned, one cycle of the net knotting step is finished and the cycle is repeated hereafter. Rolling back the net rolled around the roller as foregoing, as shown in FIG. 6, groups of the weft 2 run slantly against groups of the warp 1 running straightly and meet the warp 1 through knots, and the weft 2 travels as much as the pitch of the warp 1 to the left between knots. Unfolding the net, as shown in FIG. 7, groups of warp 1 and those of the weft 2 meet each other at a right angle.

Second Embodiment (Refer FIGS. 8 to 17)

This net knotting machine is of a circular type, and the net is formed in cylindrical shape. Numeral 4 is a guide hook ring which forms a guide hook 10 in pectinate and fixed on the inner circumferential wall of a L-shaped ring 12 on a fixed basic ring 50 set up in an inside support 11. Numeral 5 is an upper hook set up on almost right overhead the guide hook 10 and pivotably supported by a support ring 13. A gear 14 cut in on the support ring 13 is turned by means of a rack ring 15 turning inside said support ring 13. Said support ring 13 is held by a support bracket 71 fixed on an outside support 20. A gear 70 rotated by a motor 69 on said support ring 13 engages with said rack ring 15 and swings on an inside convex edge 79 of the support ring 13. Said upper hook 5 is unable to slant backward and forward, so that a thread hanging portion 16 is bent sidewards so as to be tripped by turning when a knot 3 is pulled out for fastening the mesh. Numeral 17 is a supporting disc of a warp tube 23, on the outer circumference of which a gear 19 engaging with a driving force gear 18 is cut in. The disc rotates on an orbital ring 21 arranged on an outer support 20 and has a circular rod 22 hanging at the middle lower surface thereof. Radially around the rod 22, the warp tubes 23 winding the warp 1 around the tube are supported.

Numeral 24 is a drawing control device of warp 1 and comprises a basic ring 26 having a convex line engageable with a key slot 25 of said circular rod 22, a vertically movable portion 29 composed of an inner ring 27 connected with an outer ring 28 and a fixed ring 30 set by the circular rod 22. A vertical rod 31 connected to said basic ring 26 passes through the disc 17 at a hole 32 and connects to a bar 34 pivoted by a pivot 33 fixed on the disc 17. The other end of said bar 34 connects to a cam 72 and the drawing control device 24 makes prescribed vertical movement rotating with the disc 17. When the vertically movable portion 29 falls, the warp 1 drawn out of the warp tube 23 stops drawing, being caught by the outer ring 28, the fixed ring 30 and the inner ring 27. Numeral 75 is a rotating shaft of the cam 72 and located on the disc 17 with a motor 76 setting a cam 73 and a cam 74 to be described later. Numeral 35 is a warp guide ring actuator and a warp guide member 39 is arranged on the outer circumference of a circular ring 38 connected to a basic ring 37 engaging a key slot 36 of said circular rod 22 with a convex line on the inner surface of the actuator.

Numeral 40 is a vertical rod set on said basic ring 37, which passed through the hole of said disc 17 and connects to a horizontal rod 41 pivoted to said pivot 33. Said horizontal rod 41 connects to said cam 73, and the warp guide member 39 makes required vertical movement, rotating with the disc 17.

Numeral 42 is a mesh fastening device arranged below said guide ring actuator 35. The convex line on a basic ring 43, 44 engages with the key slot 36 of said circular rod 22. A mesh fastening ring 45 connects to the basic ring 43, 44. A vertical rod 62 connected to the basic ring 43 passes through said disc 17 and the upper end of which connects to a horizontal rod 64 connecting to a cam 74, making said pivot 33 as a fulcrum. While the drawing of the wrap 1 is suspended by means of the drawing control device 24, meshes are fastened by making them fall. Respective joining parts 63 between said vertical rods 40, 31, 62 and horizontal rods 41, 34 and 64 are desired to be universal joints.

Numeral 46 is a net sliding ring guiding a net 83, corresponding to the inside of said guiding hook ring 4 and attached to a support rod 68 connected to an unrotatable basic ring 47 engaged and supported to the lower end of said circular rod 22.

Numeral 65 is an inner convex line of said basic ring 47; 66 is an outer circumferential groove of said circular rod 22 and 67 is a ball lain between the inner convex line 65 and the outer circumferential groove 66.

Numeral 8 is a bobbin case housing a bobbin winding the weft 2 and radially arranged on the outer circumference of the guide hook ring 4 loaded on a bobbin case receiver 9, equal in number to the number of the warp tubes 23. Said bobbin case receiver 9 is arranged on said fixed basic ring 50 so as to be oscillated through a roller 51.

Numeral 52 is a L-shaped bar engaged with a connecting ring 53 fixed on said support 11, the upper end of which is pivoted to said bobbin case receiver 9 through a connecting rod 86, and through the lower top of which a connecting ring 77 passes and a connecting rod 54 hangs down at proper spaces. The top of a roller 55 is rolled on a cam 80 rotated by a motor 78, and the bobbin case receiver 9 is travelled back and forth. Numeral 56 is a spring loaded between said L-shaped bar 52 and the fixed basic ring 50; 61 is a thread trip arranged at the tail end of the bobbin case receiver 9 and 84 is a tooth form cut in on the inner circumferential surface of the cam 80.

Figure 15:
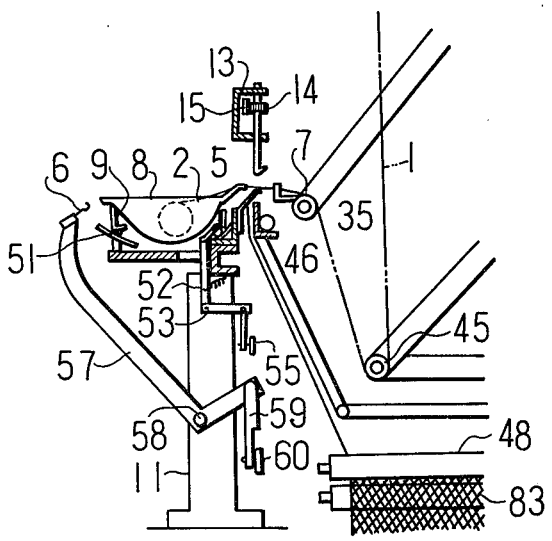

Numeral 6 is a lower hook drawing out the loop of the warp 1, as shown in FIG. 15, the top of which is bent sideward and attached to the top end of a support rod 57 so as to be overhead said bobbin case 8. Said support rod 57 forms L-shape and engages with a connecting ring 58 fixed to said inner support 11, and the lower end of the support rod 57 is connected to a connecting rod 59 and said lower hook 6 is actuated outward against a spring 87 through a roller 60 rolling on a cam 82 driven by a motor 81. Numeral 85 is a tooth form cut in on the inner circumferential surface of said cam 82. Each of the upper hook 5, the lower hook 6, the bobbin case 8, the bobbin case receiver 9, the warp tube 23, the warp guide member 39, the L-shaped bar 52, the support 57, etc. mentioned above is arranged on each circumference, at equal pitch and in equal number.

Figure 16:
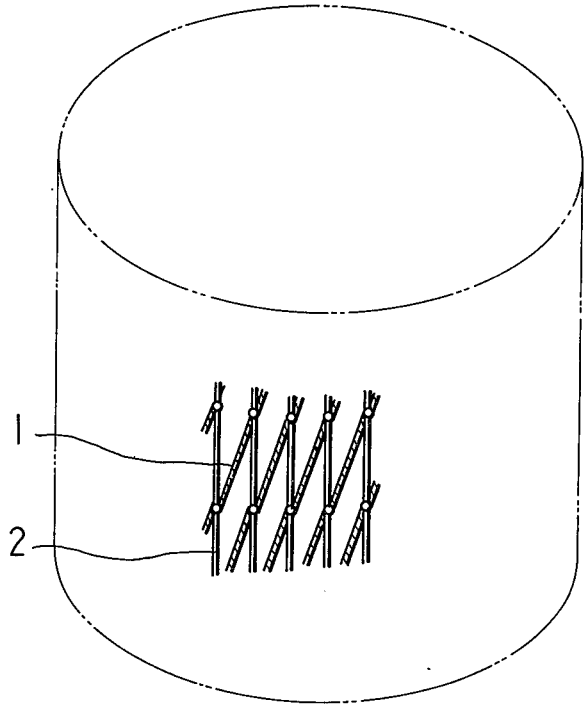

The circular net knotting machine is constituted as mentioned above:

The upper hook 5 is turnable in natural and reverse directions by means of the rack ring 15 through the gear 14; the warp guide member 39 is able to travel vertically and turnable in natural and reverse directions around the circular rod 22; the bobbin case 8 is able to swing and guide the weft 2 to the position service able to hang it to the upper hook 5 by the rise of the inner end as well as to trip the loop of the warp 1 hanged to the lower hook 6 when the outher end falls together with the thread trip 61; the upper hook 5 is unable to slant for tripping the loop of knotted thread as like as the upper hook 4 in the first embodiment, however, the upper hook 5 bends to a certain direction at the thread hanging portion 16, so that the loop of the knot can be taken out of the upper hook 5 by swinging the circular ring 38 to the direction, after knotting the thread. Therefore, as same construction of knot as in the first embodiment can be formed in the circular net knitting machine. And, as shown in FIG. 16, after finishing one knot, when the roller 49 is turned to the definite direction as much as an angle equal to the pitch of the warp 1 every time rolling one mesh, the weft 2 is arranged in parallel to the generating line of the cylinder, which the warp 1 is spirally arranged to the cylinder, and that the warp 1 meets the next weft 2 and forms the knot thereof till one knot to another.

Figure 17:
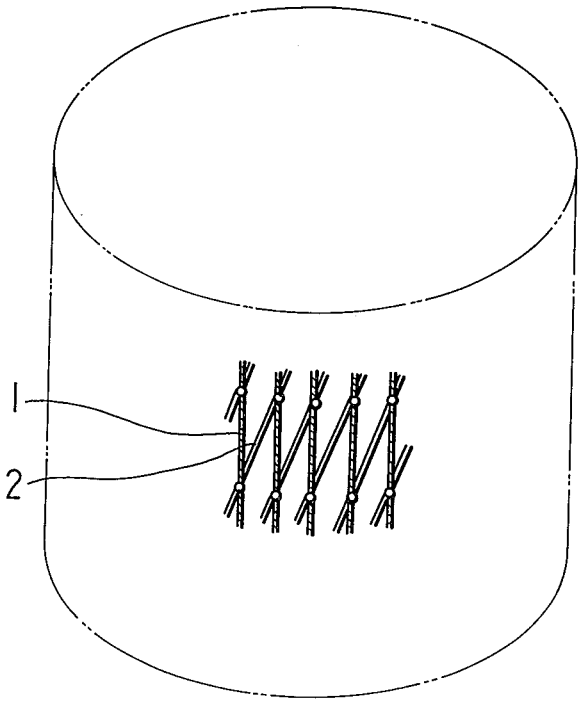

Moreover, in the second embodiment, in place of turning the disc 17 one graduation between one knot and another, if the bobbin case is adapted as turning to a certain direction a pitch by pitch, as shown in FIG. 17, the warp 1 is arranged in prallel to the generating line and weft is spirally, arranged, and as same net as shown in the first embodiment can be formed. The cylindrically formed net is cut along the generating line at one spot and then unfolded, the square-meshed net which warp 1 and weft 2 meet each other at a right angle can be attained.

What is claimed is:

1. Method for knotting a square-meshed net, comprising the steps of arranging warp strands and weft strands on the inside and outside of upper hooks arranged in circular form, each particular warp (or weft strand being opposite a particular upper hook and a particular weft (or warp) strand, knotting each particular warp (or weft) strand to the particular weft (on warp) strand by the particular upper hook, and transferring the particular weft (or warp) strand in one cycle of the knotting to a next adjacent upper hook in a prescribed direction and knotting it to the next adjacent warp (or weft) strand, by said next upper hook.

2. Knotting machine for square-meshed net with upper hooks 5 arranged in circular form, said knotting machine comprising: a stationary guide hook ring 4; a supporting disc 17 carrying a warp tube 23 rotatably supported above the guide hook ring 4; a circular rod 22 hung at the center of said supporting disc 17; a drawing control device 24 being concentric to said circular rod 22 and mounted thereon moveable in the vertical direction, said control device having rings arranged downward in sequence; a warp guide member 39 vertically moveably mounted on said circular rod below said control device; a mesh fastening ring 45 vertically moveably mounted on said circular rod below said guide member; an upper hook rotating rack ring 15 supported above said guide hook ring 4; a bobbin case receiver 9 having a bobbin case 8 arranged radially outwardly from and being mounted on the outer circumference of said guide hook ring 4; and a supporting rod 57 supporting lower hooks 6 and pivotally mounted adjacent said bobbin case.

3. Knotting machine for square-meshed net according to claim 2, wherein the circular rod 22 is formed in circular section and the supporting disc 17 in disc shape, a basic ring 43 is keyed to the circular rod 22, and a mesh fastening ring 45 connected to the basic ring 43 is rotatable in association with the supporting disc 17 and moveable in the vertical direction.

4. Knotting machine for square-meshed net according to claim 3, wherein a vertical rod connected to the basic ring passes through the supporting disc and is rockably connected to a horizontal rod with respect to the fulcrum on the supporting disc.

5. Knotting machine for square-meshed net according to claim 2, wherein the upper hook driven by the rack ring is provided with a thread hanging portion on the lower end, and the tip of the thread hanging portion is bent towards the rotating direction of a warp guide member.

6. Knotting machine for square-meshed net according to claim 2, wherein the drawing control device is composed of an outer ring and an inner ring moveable in the vertical direction and a fixed ring installed below both rings.

7. Knotting machine for square-meshed net according to claim 2, wherein the lower end of the circular rod is provided with a net sliding ring in opposition to the inside of the guide hook ring, and a pulling roller and a winding roller are arranged below the circular rod.

8. Knotting machine for square-meshed net according to claim 7, wherein the net sliding ring is rotatably attached to the circular rod.

* * * * *